US006050346A

United States Patent [19]

Hipp

[11] Patent Number: 6,050,346

[45] Date of Patent: Apr. 18, 2000

[54] HIGH TORQUE, LOW SPEED MUD MOTOR FOR USE IN DRILLING OIL AND GAS WELLS

[75] Inventor: James E. Hipp, New Iberia, La.

[73] Assignee: Baker Hughes Incorporated, Houston, Tex.

[21] Appl. No.: 09/022,598

[22] Filed: Feb. 12, 1998

[51] Int. Cl.[7] ..... F21B 1/06; F21B 4/14

[52] U.S. Cl. ..... 173/78; 173/64; 173/73; 173/80; 173/91; 175/296

[58] Field of Search ..... 173/90, 73, 78, 173/64, 110, 80; 175/19, 296, 305; 166/178, 301

[56] References Cited

U.S. PATENT DOCUMENTS

| | | | |
|---|---|---|---|
| 3,946,819 | 3/1976 | Hipp | 175/296 |
| 4,462,471 | 7/1984 | Hipp | 175/296 |
| 4,702,325 | 10/1987 | Hipp | 173/64 |
| 4,958,691 | 9/1990 | Hipp | 175/296 |
| 5,085,284 | 2/1992 | Fu | 175/296 |
| 5,107,944 | 4/1992 | Gustafsson | 173/91 |
| 5,139,096 | 8/1992 | Lister | 173/78 |
| 5,156,223 | 10/1992 | Hipp | 175/296 |
| 5,318,140 | 6/1994 | Ekwall et al. | 173/80 |
| 5,396,965 | 3/1995 | Hall et al. | 173/73 |
| 5,419,403 | 5/1995 | Klemm | 173/78 |
| 5,680,904 | 10/1997 | Patterson | 175/296 |

*Primary Examiner*—Scott A. Smith

[57] ABSTRACT

A improved "mud motor" for use in oil and gas well drilling includes a reciprocating valve and piston arrangement that generates power using drilling fluid media (e.g., drilling mud) pumped through an inlet port to form a differential across a piston seat. The differential pressure causes the valve and piston assembly to move down in an elongated body. Rollers then force telescoping, reciprocating fingers to rotate while absorbing the reciprocating up and down action of the valve and piston assembly. This clockwise rotation causes a transmission that includes a clutch shaft and sprags to engage a clutch housing causing the drill bit to turn. Thrust bearings allow weight to be applied to the tool to optimize drilling action. The apparatus can be used in well drilling or in the removal of obstructions such as bridge plugs, metal and rubber from the well bore.

38 Claims, 18 Drawing Sheets

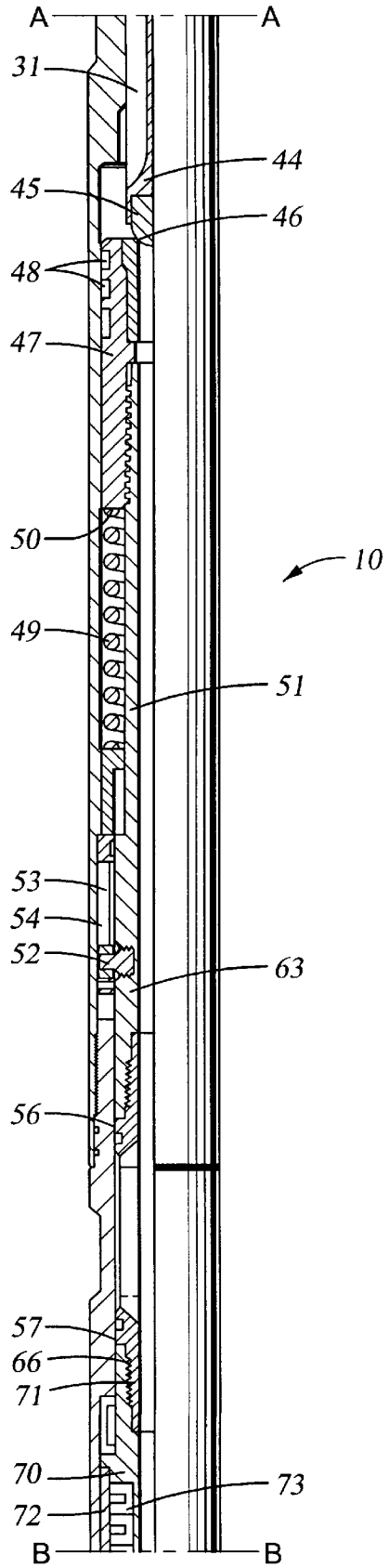
Fig. 4
Fig. 6
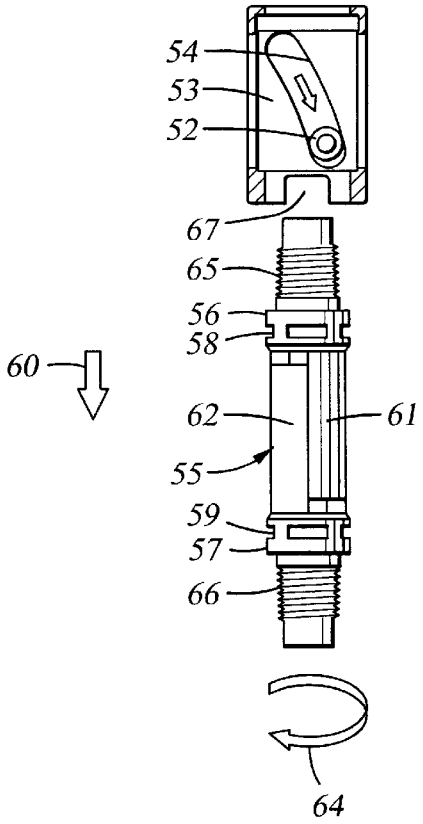

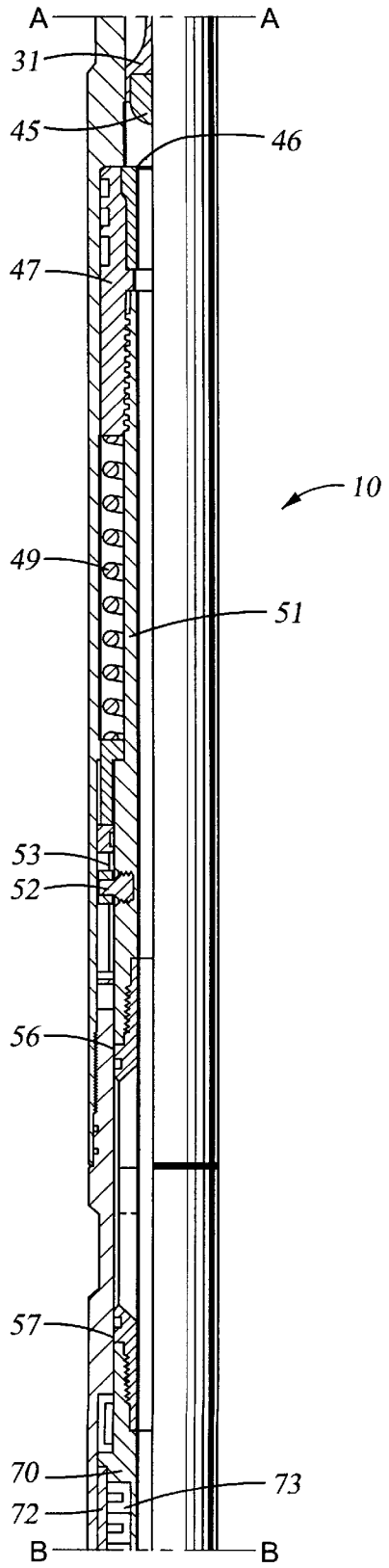
Fig. 8
Fig. 10
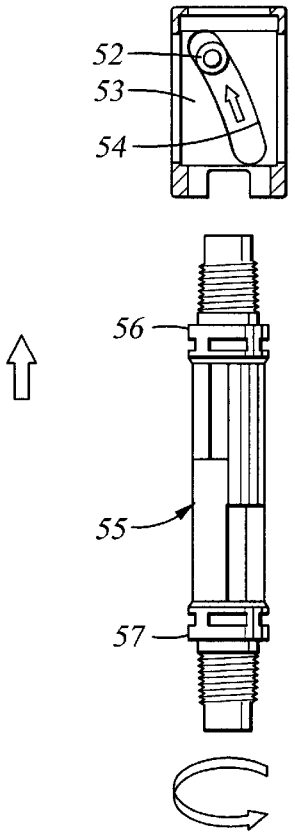

HIGH TORQUE, LOW SPEED MUD MOTOR FOR USE IN DRILLING OIL AND GAS WELLS

BACKGROUND OF THE INVENTION

1. Field of the Invention

The present invention relates to oil and gas well drilling and more particularly, to an improved mud motor for drilling oil and gas wells and for drilling through obstructions, plugs and the like, in oil and gas wells wherein a high torque, low speed (i.e. low r.p.m.) motor is operated with a reciprocating valve and piston arrangement that uses differential fluid pressure for power and a transmission that isolates impact generated by the reciprocating valve and piston from the drill bit.

2. General Background of the Invention

In the drilling and maintenance of oil and gas wells, it is often required that a drill bit be used to eliminate an obstruction, plug, cement or like that is present within the well bore. In my prior U.S. Pat. No. 5,156,223, there is disclosed a drill that rotates for drilling through cement, rock, and any other media through which a drill bit must travel during oil and gas well drilling. In that prior patent, a reciprocating valve and piston arrangement is used to generate a high impact tool that drills and impacts the drill bit during the drilling process.

In prior U.S. Pat. No. 3,946,819, naming the applicant herein as patentee, there is disclosed a fluid operated well tool adapted to deliver downward jarring forces when the tool encounters obstructions. The tool of my prior U.S. Pat. No. 3,946,819, generally includes a housing with a tubular stem member telescopically received in the housing for relative reciprocal movement between a first terminal position and a second terminal position in response to fluid pressure in the housing. The lower portion of the housing is formed to define a downwardly facing hammer and the stem member includes an upwardly facing anvil which is positioned to be struck by the hammer. The tool includes a valve assembly that is responsive to predetermined movement of the stem member toward the second terminal position to relieve fluid pressure and permit the stem member to return to the first terminal position. When the valve assembly relieves fluid pressure, the hammer moves into abrupt striking contact with the anvil. The tool of prior U.S. Pat. No. 3,946,819, is effective in providing downward repetitive blows. The tool of the '819 patent will not produce upwardly directed blows.

In prior U.S. Pat. No. 4,462,471, naming the applicant herein as patentee, there is provided a bidirectional fluid operated jarring apparatus that produces jarring forces in either the upward or downward direction. The jarring apparatus was used to provide upward or downward impact forces as desired downhole without removing the tool from the well bore for modification. The device provides downward jarring forces when the tool is in compression, as when pipe weight is being applied downwardly on the tool, and produces strong upward forces when is in tension, as when the tool is being pulled upwardly.

In U.S. Pat. No. 4,462,471, there is disclosed a jarring or drilling mechanism that may be adapted to provide upward and downward blows. The mechanism of the '471 patent includes a housing having opposed axially spaced apart hammer surfaces slidingly mounted within the housing between the anvil surfaces. A spring is provided for urging the hammer upwardly. When it is desired to use the mechanism of the '471 patent for jarring, a valve including a closure and a compression spring is dropped down the string to the mechanism.

In general, the mechanism of the '471 patent operates by fluid pressure acting on the valve and hammer to urge the valve and hammer axially downwardly until the downward movement of the valve is stopped, preferably by the full compression of the valve spring. When the downward movement of the valve stops, the seal between the valve and the hammer is broken and the valve moves axially upwardly.

The direction jarring of the mechanism of the '471 patent is determined by the relationship between the fluid pressure and the strength of the spring that urges the hammer upwardly. Normally, the mechanism is adapted for upward jarring. When the valve opens, the hammer moves upwardly to strike the downwardly facing anvil surface of the housing.

In desirably low impact situations, there is a need for a drill motor that operates with well drilling fluid or drilling mud. Such "mud motors" have been commercially available for a number of years. All motors referred to as "mud motors" are of multi-lobe positive displacement operating on the "Moineau" principal. One of the limitations of these "mud motors" is their inability to operate in temperatures above about 250° Fahrenheit. Another limitation of such "mud motors" is that they cannot operate for any length of time on nitrogen or nitrofied foam. They typically include a rotating member that is powered with the drilling mud as it flows through an elongated tool body. Suppliers of such "mud motors" include Drillex, Norton Christiansan, and Baker.

A second type of drill on the market is the "vane type". These drills were developed to overcome the temperature and gas operation limitations of the Moineau motors. The disadvantage of the vane type motors is their high speed and inability to tolerate foreign material.

BRIEF SUMMARY OF THE INVENTION

The apparatus of the present invention solves the problems confronted in the art in a simple and straightforward manner. What is provided is a highly efficient motor apparatus that utilizes a reciprocating valve and piston arrangement to power the device on any fluid and without temperature limitations, which eliminates vibration, reciprocation and impact at the drill bit.

The present invention thus provides an improved, high torque, low speed (i.e., low r.p.m.), versatile drill for use in oil and gas well drilling.

The present invention provides an improved fluid operated drill motor that operates on a larger variety of drilling fluids at higher temperatures.

The apparatus includes an elongated tool body having a flow bore for conveying fluid through the full length of the tool body until it reaches a drill bit attached to the lower end portion of the tool body.

The tool body includes an upper end portion with a connector that enables the tool body to be attached to a coil tubing unit, drill string or work string, and a lower connector that enables a drill bit to be connected to the lower end of the tool body.

A reciprocating valve member travels between a first upper and a second lower position within the tool body bore. A piston carried in the tool body bore below the valving member has an upper end portion with a valve seat. The valving member has a lower end portion that can form a seal with the valve seat of the piston.

This enables the piston to be powered and move downwardly within the flow bore and with the valving member.

This differential fluid pressure is applied to the combination of the valving member and the piston when the valving member lower end portion forms the seal with the seat of the piston. During such downward movement, one or more compressible valving member springs are positioned in the tool body to engage the valving member. The springs gradually compress as the valving member and piston move downwardly within the flow bore.

A full compression of the valving member springs stores sufficient energy in the springs to enable the springs to override the fluid pressure acting on the combination of the piston and valving member. The fully compressed springs enable the valving member to separate from the piston and its seat.

A transmission is provided that rotates the drill bit without transmitting impact thereto from either the reciprocating piston or the reciprocating valving member. The transmission can include a splined linkage that has first and second interlocking, telescoping members.

The transmission can include a helix with a diagonal extending slot and a roller that travels within the slot. The roller moves with the piston and the helix is connected via a clutch to the drill bit.

The transmission can include a piston roller shaft pending from the lower end portion of the piston, a roller carried by the piston roller shaft, and a helix with a slotted portion that receives the roller.

A piston spring returns the piston to its upper position when the valve springs separate the valving member from the piston.

The apparatus further includes an "interruption means" for momentarily interrupting fluid flow in the bore during a cycle of the valving member between its upper and lower positions. This fluid interruption means preferably includes a fluid interruption member positioned above the valving member and below the flow inlet port.

The valving member has an upper end portion with a hammering surface thereon and there is further provided a tappet positioned in the flow bore above the valving member. The tappet is in a position that enables the valving member to strike the tappet when the valving member travels from a lower to an upper position. The tappet momentarily interrupts flow in the bore at the upper end portion of the tool body when it is struck by the valving member.

The valving member and piston move downwardly in the tool body gradually compressing both the valving member spring and the piston spring during use.

There are preferably a plurality of valving member springs positioned in the flow bore, each engaging the housing and the valving member, the springs preferably being of different diameters and different spring constants.

The transmission preferably includes a telescoping member that retracts when the valving member and piston move from the first, up position to the second, lower position.

The transmission preferably includes means for translating reciprocating movements of the piston into rotational energy while isolating the drill bit from any substantial reciprocating movement of the piston.

Rotation speed is adjustable and managed mechanically through the helix angle and the length of the piston stroke.

Rotation speed is also a function of fluid volume control from the surface (i.e., a higher volume generates a faster stroke).

Torque is adjustable and managed mechanically through the bore of the operating cylinder and the predetermined operating pressure range of the valving springs. Torque is also a function of the amount of bit load applied from the surface. The higher the bit load, the higher the pressure (p.s.i.) required to stroke. The higher the pressure, the higher the torque.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein:

FIG. 4 is a schematic, sectional elevational view of the preferred embodiment of the apparatus of the present invention illustrating the central portion of the tool body;

FIG. 6 is a schematic, elevational view illustrating the preferred embodiment of the apparatus of the present invention, particularly the roller assembly, helix and reciprocating finger portions thereof;

FIG. 8 is a sectional, elevational view of the preferred embodiment of the apparatus of the present invention illustrating the central portion of the tool body after the valve has fired from the seat of the piston and struck the tappet;

FIG. 10 is a sectional, elevational view of the preferred embodiment of the apparatus of the present invention illustrating the helix, roller, and reciprocating finger portions thereof in their uppermost position;

DETAILED DESCRIPTION OF THE INVENTION

Figure 1:
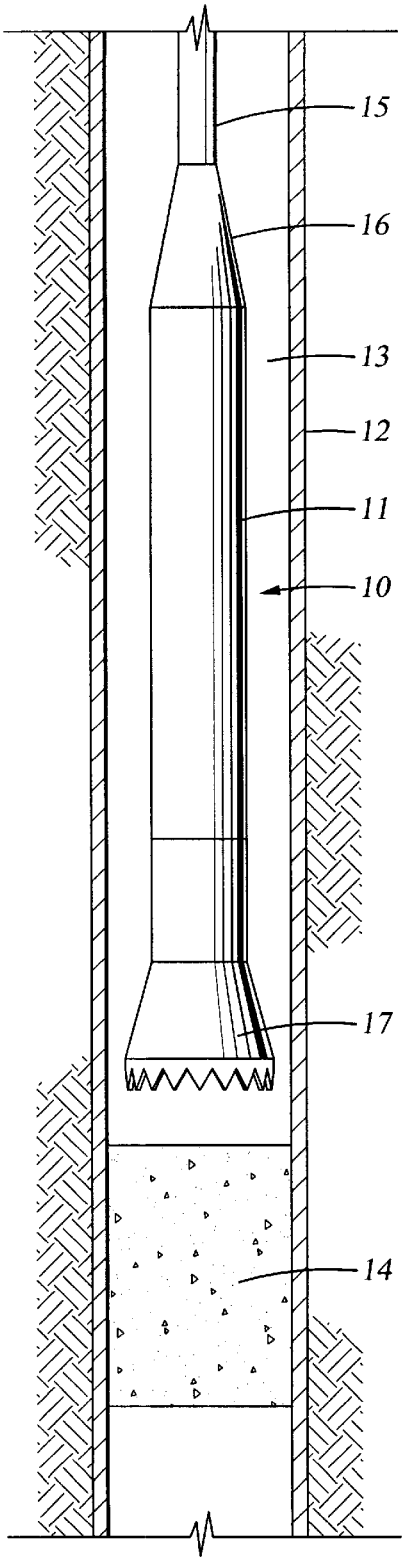
FIG. 1 is a schematic elevational view of the preferred embodiment of the apparatus of the present invention shown during use wherein a drill bit is about to engage an obstruction to be drilled.
Figure 2:
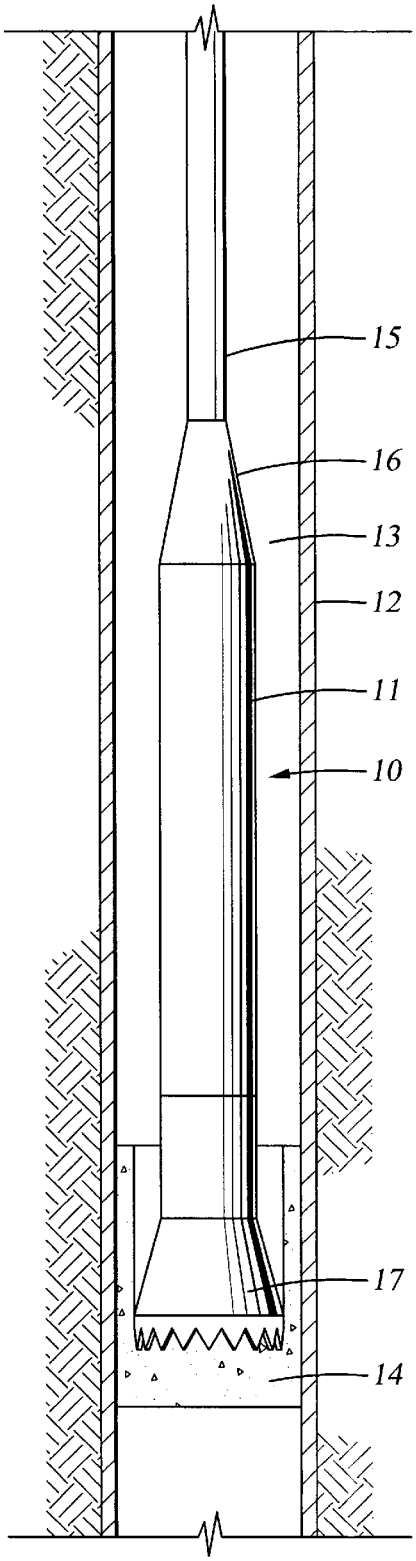
FIG. 2 is an elevational, schematic view of the preferred embodiment of the apparatus of the present invention during drilling through an obstruction such as a bridge plug, metal, or rubber.

In FIGS. 1 and 2, well drilling motor apparatus 10 is in the form of an elongated tool body 11 that can be placed in the well annulus 13 of well tubing 12. The apparatus 10 of the present invention can be used to drill through shale, rock, sand, scale, or cement. It can also remove obstructions. In FIG. 1, an obstruction to be drilled is designated by the numeral 14. The obstruction 14 can be for example, a bridge plug, or metal or rubber object.

Figure 3:
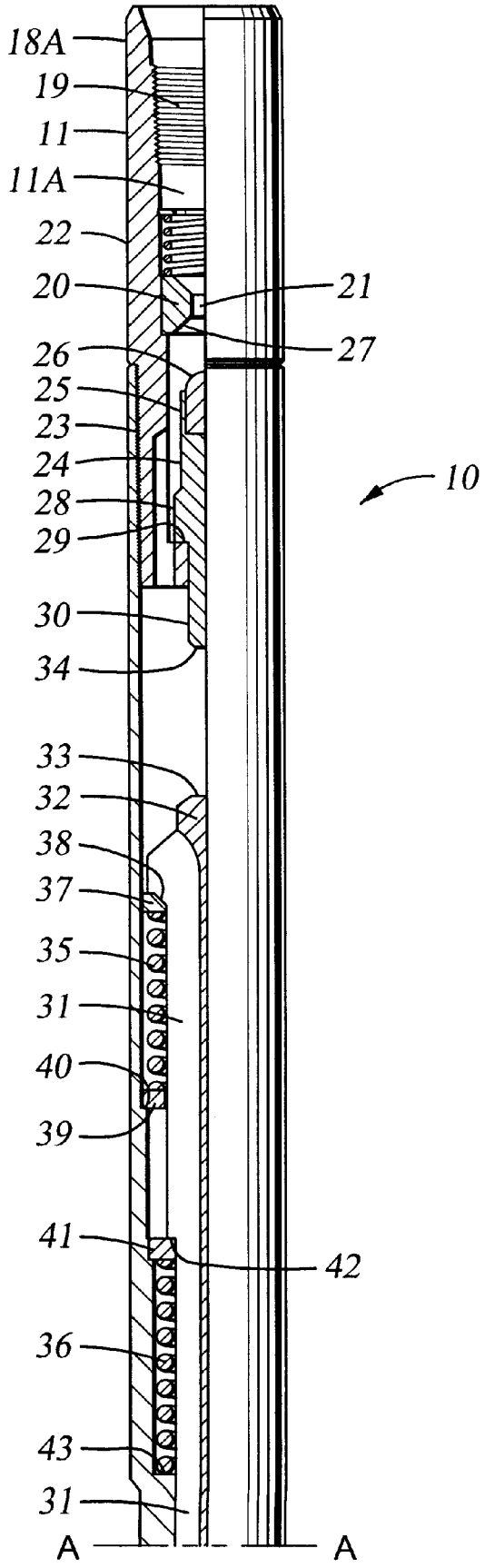
FIG. 3 is a schematic, sectional elevational view of the preferred embodiment of the apparatus of the present invention illustrating the upper end portion of the tool body.
Figure 5:
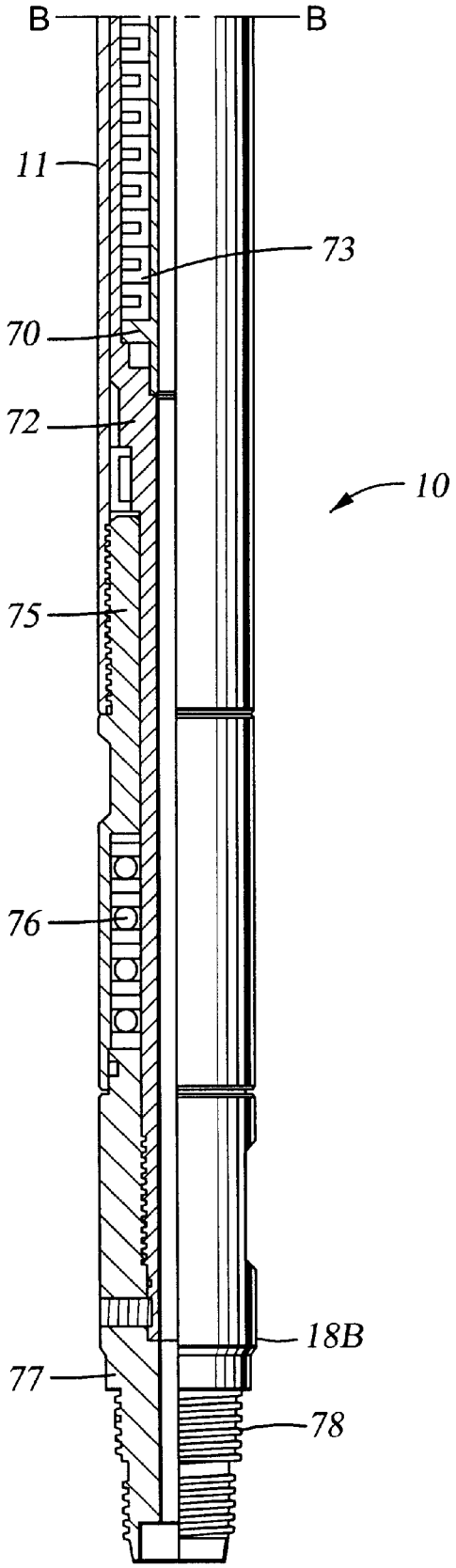
FIG. 5 is a schematic, sectional elevational view of the preferred embodiment of the apparatus of the present invention illustrating the lower end portion of the tool body.

In FIG. 2, the drill bit 17 attached to the lower end portion of tool body 11 is shown drilling through the obstruction 14. A connector 16 attaches the upper end portion of the tool body 11 to a work string such as a coil tubing string 15. A connector 16 can be used to form an attachment between the lower end portion of coil tubing string 15 and the upper end portion of tool body 11. FIGS. 2–10 show a first embodiment of the apparatus of the present invention shown generally by the numeral 10 in FIGS. 3–5 and 7–9. The drawing FIGS. 3–5 show respectively the upper, central and lower portions of tool body 11. The match line AA of FIG. 3 fits the match line AA of FIG. 4. The match line BB of FIG. 4 fits the match line BB of FIG. 5.

The elongated tool body 11 has a flow bore 11A for transmitting fluids between the upper end portion 18A of tool body 11 and the lower end 18B portion thereof. Lower end portion 18B of tool body 11 has external threads 78 for example, that enable a drill bit 17 to be threadably attached to the tool body 11 at thread 78. Upper end portion 18A of tool body 11 has internal threads 19 that form a connection with a suitable threaded sub or connector 16 that forms the interface in between tool body 11 and coil tubing unit 15 or like work string.

Tool body 11 includes a bore 11A that carries inlet port fitting 20 having a restricted diameter opening 21 for controlling the quantity of fluid flowing into the tool body bore 11A. Sub 22 defines the uppermost section of tool body 11 that carries inlet port fitting 20. Sub 22 connects to the remainder of tool body 11 at threaded connection 23.

Figure 7:
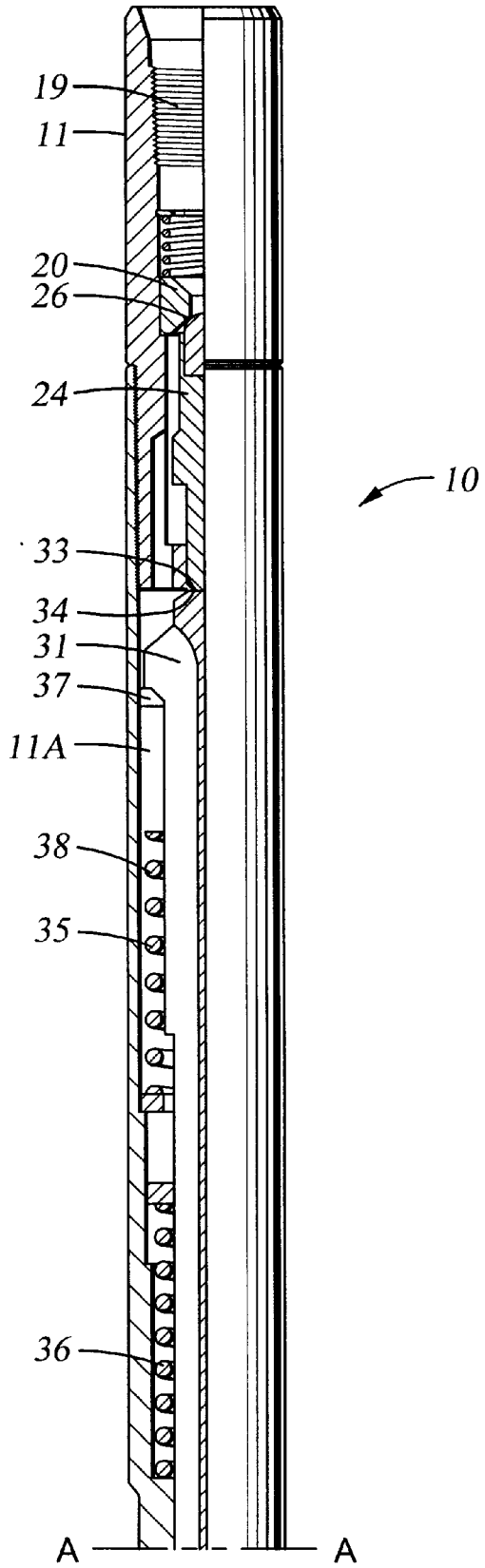
FIG. 7 is a sectional, elevational view of the preferred embodiment of the apparatus of the present invention illustrating the upper end portion of the tool body after the valve has fired from the seat of the piston and struck the tappet.

Tappet 24 is mounted at the lower end of sub 22, being slidably mounted to sub 22 above shoulder 29. The tappet 24 has an enlarged portion 28 that rests upon shoulder 29 when tappet 24 is in a lower position as shown in FIG. 3. Upper end 25 of tappet 24 provides a valving member 26 that fits against and forms a closure with seat 27 on the inlet port fitting 20. This closed position of tappet 24 against seat 27 is shown in FIG. 7. The lower end 30 of tappet 24 has a flat anvil surface 34 that corresponds in size and shape generally to hammering surface 33 on valving member 31. This enables the valving member 31 to drive the tappet 24 upwardly and into the sealing position of FIG. 7 when the valving member 31 moves from its lowermost position as shown in FIG. 3 to its uppermost position as shown in FIG. 7.

A pair of annular coil springs 35, 36 are shown in FIG. 3, surrounding valving member 31 and extending between annular member 37 and annular shoulder 40. The annular member 37 is a ring that is shaped to form an interface between spring 35 and annular shoulder 38 of valving member 31. The annular member 39 is a ring that is positioned in between annular shoulder 40 and spring 35. Annular member 41 forms an interface between spring 36 and annular shoulder 42. Spring 36 also abuts annular shoulder 43 as shown in FIG. 3.

The lower end 44 of valving member 31 has a valving portion 45 that enables a seal to be formed with piston seat 46 of piston 47. In FIG. 4, piston 47 and valving member 31 are shown in their lowermost position of operation. The valving portion 45 of valving member 31 has formed a seal with the seat 48 of piston 47. Differential pressure has been used to force the combination of valving member 31 and piston 47 to the lowermost position shown in FIG. 4.

Differential pressure is created by fluid media pumped through the inlet port fitting 20 to tool body bore 11A. This fluid media forms a differential across piston seat 46 which causes the valving member 31 and piston 47 to move down to the position shown in FIG. 7–9. A plurality of annular seals 48 can be provided at the upper end portion of piston 47 for forming a fluid tight seal in between the piston 47 and tool body 11 as shown in FIG. 4.

Figure 9:
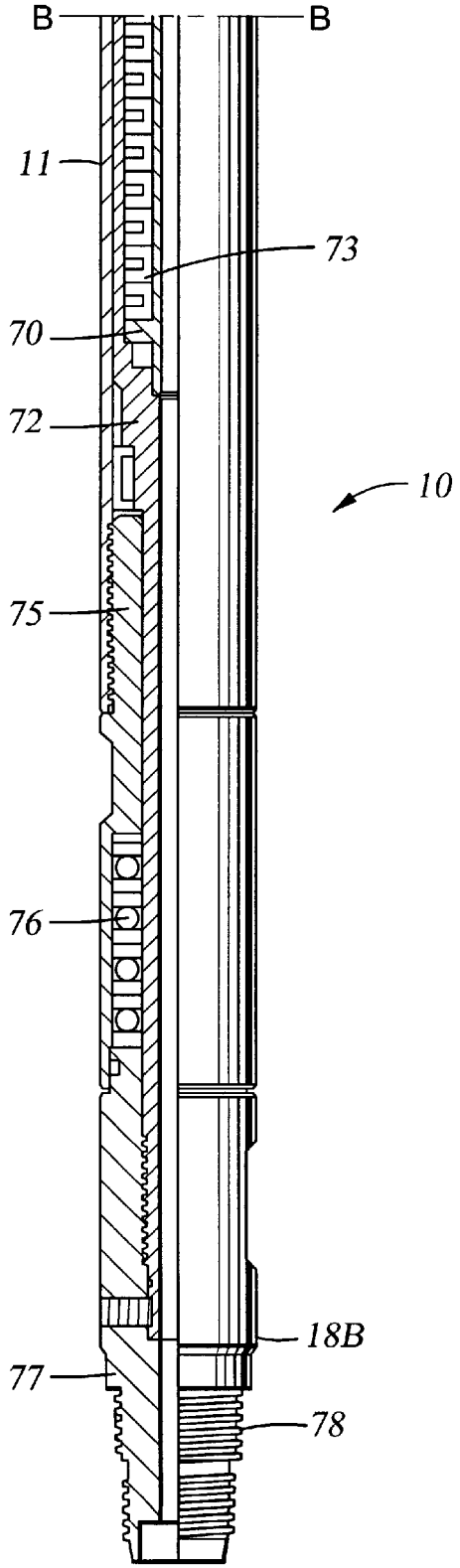
FIG. 9 is a sectional, elevational view of the preferred embodiment of the apparatus of the present invention illustrating the lower end portion of the tool body after the valve has fired from the seat of the piston and struck the tappet.

A piston return spring 49 urges the piston 47 to the uppermost position shown in FIGS. 7–9 when valve 31 and piston 47 are separated. This separation occurs due to the ever increasing force that is contained in springs 35, 36 as they are compressed with differential fluid pressure. Eventually, the springs 35, 36 become fully compressed at which point they contain stored energy sufficient to overcome the fluid differential pressure and firing the valving member 31 upwardly, at the same time separating the valving member 31 from the piston 47.

The piston return spring 49 extends between annular shoulder 50 and helix 53 as shown in FIG. 4. Piston 47 includes piston roller shaft portion 51 that extends downwardly to upper and lower reciprocating fingers 56, 57. Piston roller shaft 51 carries one or more rollers 52 that register in corresponding diagonal slots 54 of helix 53 as shown in FIGS. 6 and 10.

In FIG. 6, the roller 52 is in its lowermost position as is the valving member 31 and piston 47. In FIGS. 7–9, the roller 52 is in its uppermost position as is valving member 31 and piston 47. The upper and lower reciprocating fingers 56, 57 define a spline assembly 55 (see FIGS. 6 and 10) that is used to isolate the drill bit 17 from the reciprocating and impacting action of valving member 31 and piston 47. Upper and lower seals 58, 59 are provided respectively above and below the reciprocating fingers 56, 57.

The reciprocating fingers 56, 57 include interlocking spline portions 61, 62. The upper member is designated by the numeral 61, the lower member by the numeral 62. This spline assembly 55 enables rotary power to be transmitted through the spline assembly 55 to the drill bit 17. The rotary energy is generated when the roller 52 travels from the upper position of FIG. 10 to the lower position of FIG. 6.

Arrow 60 in FIG. 6 indicates the downward force applied to the roller 52 when the differential pressure of well drilling fluid pushes the valving member 31 and piston 47 to the lower position. Roller 52 and diagonal slot 54 translate this downward movement of the piston 47 and valving member 31 into rotational energy that is transferred through the spline assembly 55 to the drill bit 17 via clutch shaft 70, clutch housing 72, and sprags 73.

The rotational force that is transmitted to the clutch housing and sprags is designated generally by the numeral 64 in FIG. 6. A locking sleeve 63 extends between a correspondingly shaped cut out 67 of helix 53 and upper threads 65 of spline assembly 55.

Helix section 53 is held in place and attached via engagement slots 67 to outer body 11. Helix 54 is preferably removable for ease of replacement. This also allows the helix 54 to be made of harder and more brittle steel as this part will be subjected to extreme wear.

Lower threads 66 of spline assembly 55 form a connection between the spline assembly 55 and clutch housing 71. The connection between lower threads 66 and clutch shaft 70 is designated as threaded connection 71 in FIG. 4.

In FIG. 5, clutch housing 72 is shown carrying a plurality of clutch sprags 73. At the lower end portion of clutch housing 72, there can be seen thrust bearing housing 75 that contains a plurality of bearings 76. These bearings 76 support the tubing download, reducing friction loads. Drill bit sub 77 can optionally be provided in between tool body 11 and drill bit 17. The drill bit sub 77 carries external thread 78 that enables drill bit 17 to be attached thereto.

In FIGS. 7–10, the aforedescribed parts and construction of well drilling motor apparatus 10 is shown, but in an uppermost position after valving member 31 has been fired upwardly to strike tappet 24, thus separating the valving member 31 from piston 47.

In FIGS. 7–10, as the valving member 31 overrides the seat differential of well drilling fluid that is acting upon piston 47 when valving member 45 seats against piston seat 48, springs 35, 36 fire the valving member 31 upwardly until surface 33 contacts surface 34 of tappet 24. This contact forces the tappet 24 upwardly until the valving member 26 of tappet 24 seats against the annular seat 27 of inlet port 20 forming a seal therewith. This momentarily interrupts flow through the inlet port fitting 20 enabling fluid to evacuate from the tool body.

The high pressure fluid that filled the chamber above the piston must exit the tool via the flow course through the tool and out the drill bit ports. This evacuation must take place rapidly as any residual trapped pressure will retard the upward return of the piston. The valve system in the upper sub (tappet and inlet port) interrupt incoming flow to assist.

After valving member 31 is separated from piston 47, piston return spring 49 moves the piston 47 and its roller shaft 51 and roller 52 upwardly forcing the reciprocating fingers 56, 57 into counter clockwise rotation. This rotation enables the clutch shaft 70 and clutch sprags 73 to slip within clutch housing 72. The tool apparatus 10 is now poised for another downstroke. The overall effect is an up and down motion (for example, 300–500 cycles per minute) that translates into a ratcheting motion which can turn drill bit 17 with little or no impact and with high torque.

Figure 11A:
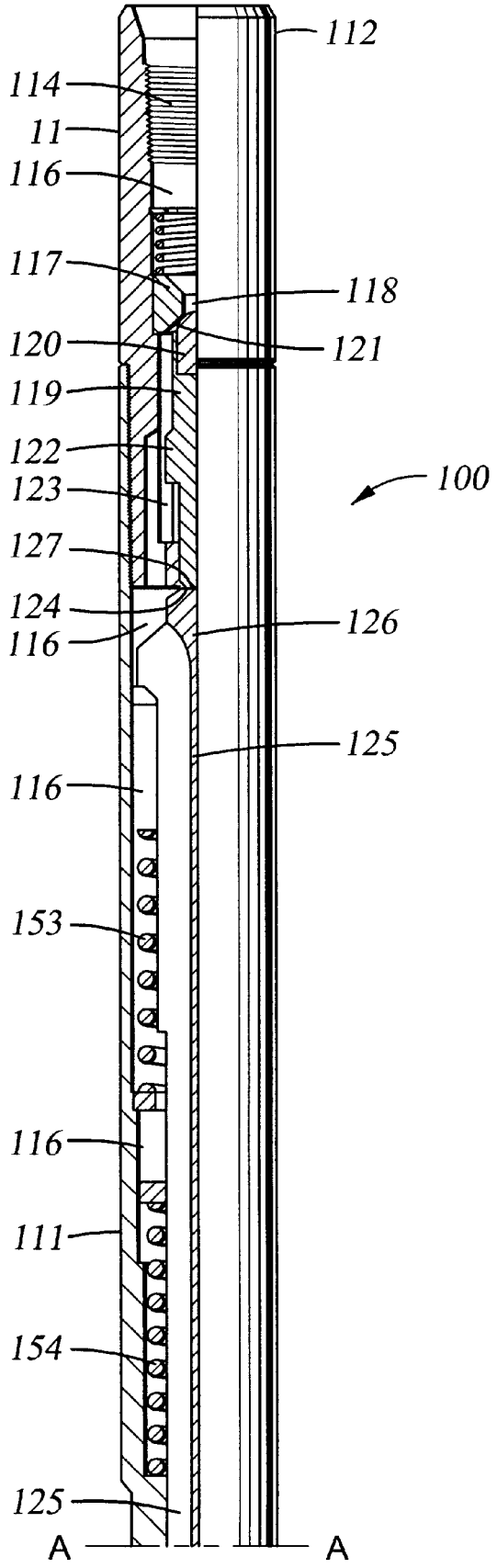
FIGS. 11A, 11B, 11C are partial sectional elevational views of a second embodiment of the apparatus of the present invention, the drawings 11A and 11B being connected at match lines "A—A" and the drawings 11B and 11C being connected at match lines "B—B" and "C—C"
Figure 11B:
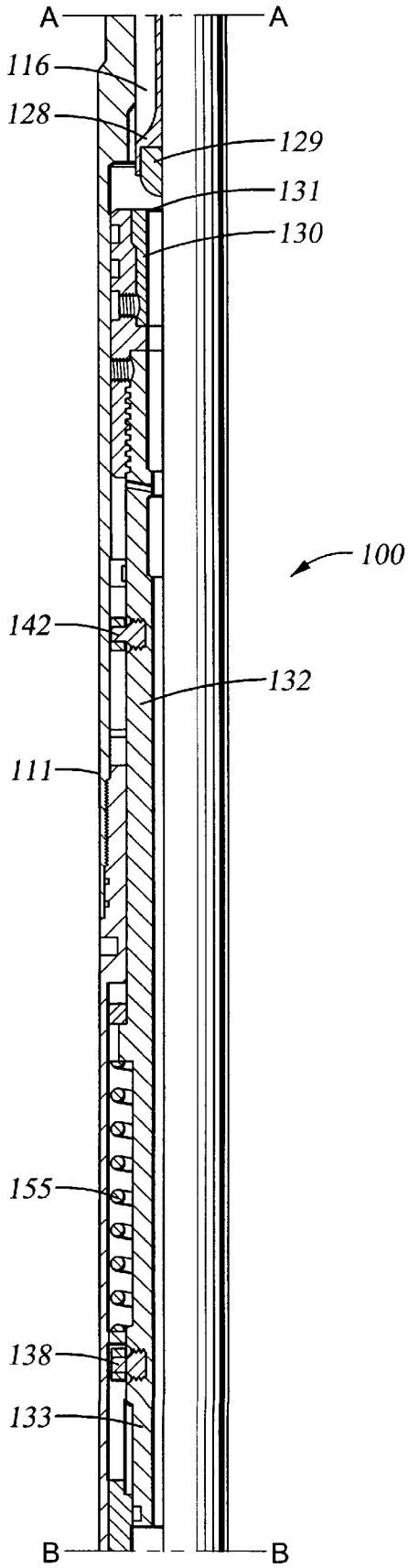
Figure 11C:
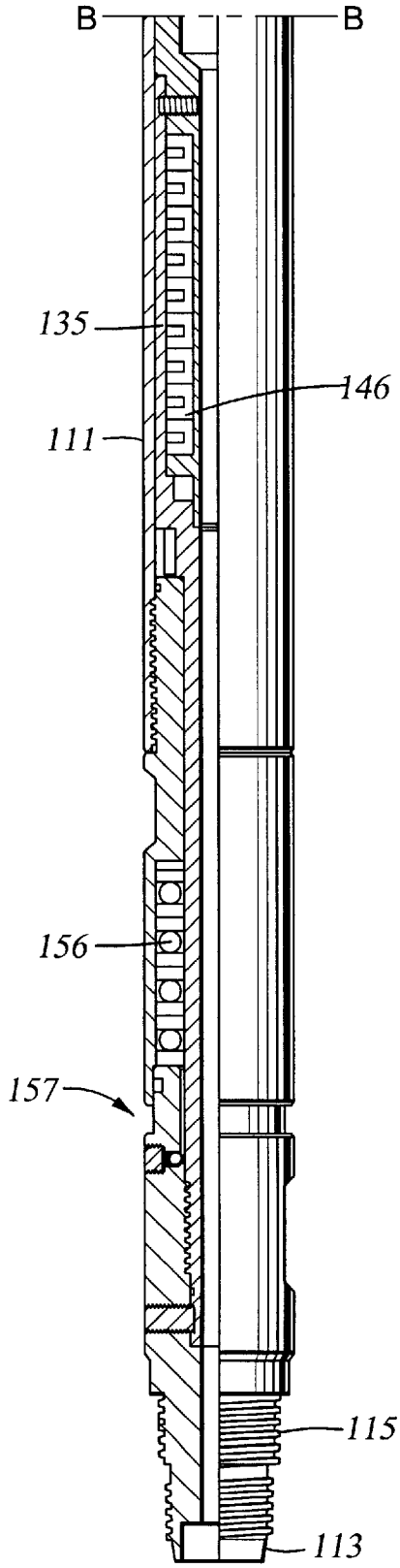
Figure 12A:
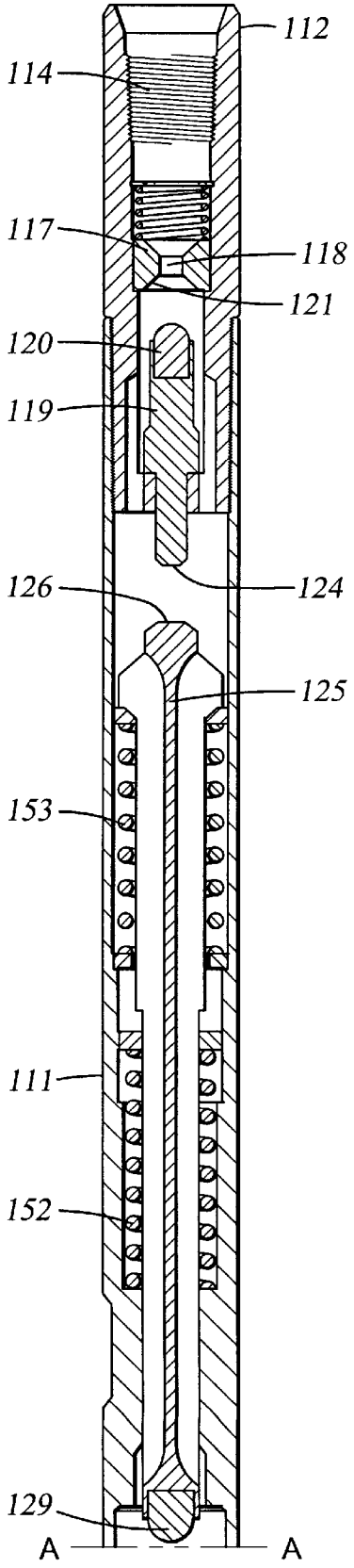
FIGS. 12A, 12B, 12C are sectional elevational exploded views of the second embodiment of the apparatus of the present invention, the drawings 12A and 12B being connected at match lines "A—A" and the drawings 12B and 12C being connected at match lines "B—B" and "C—C"
Figure 12B:
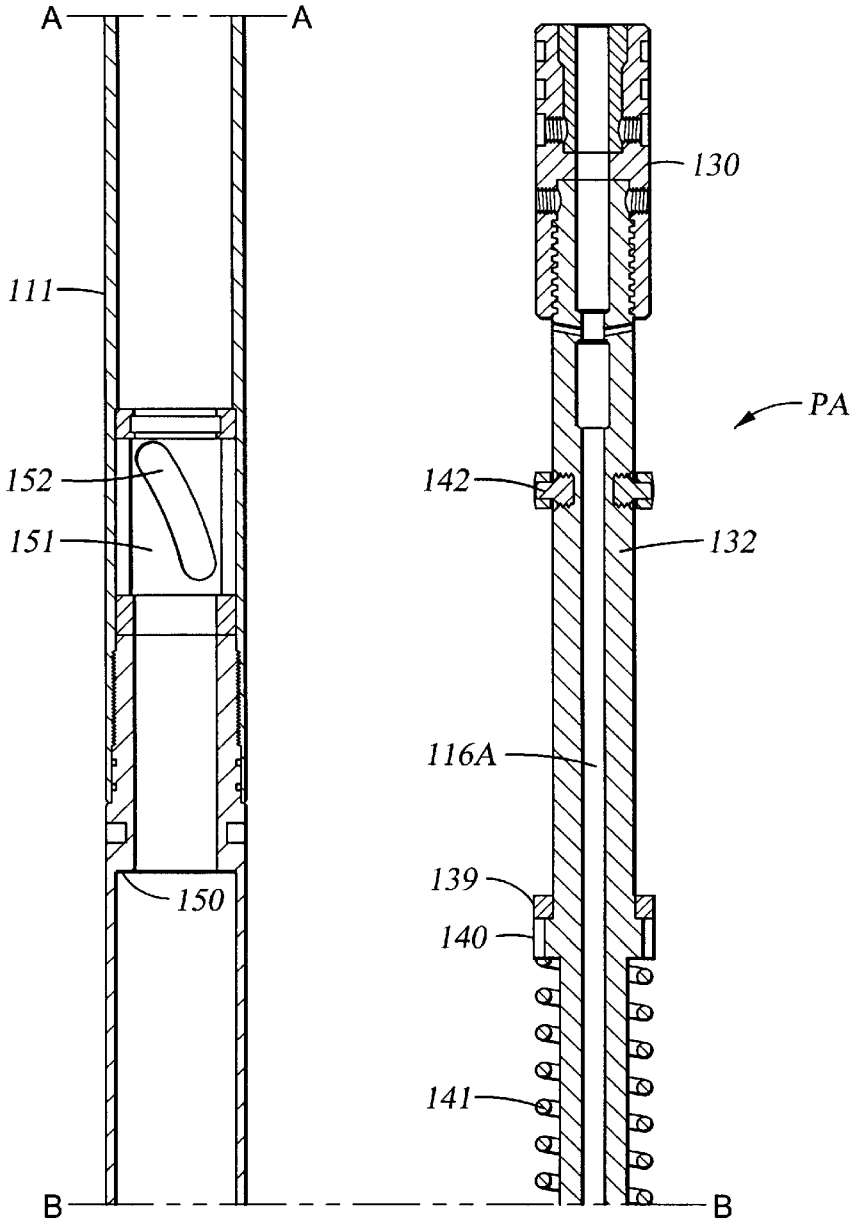
Figure 12C:
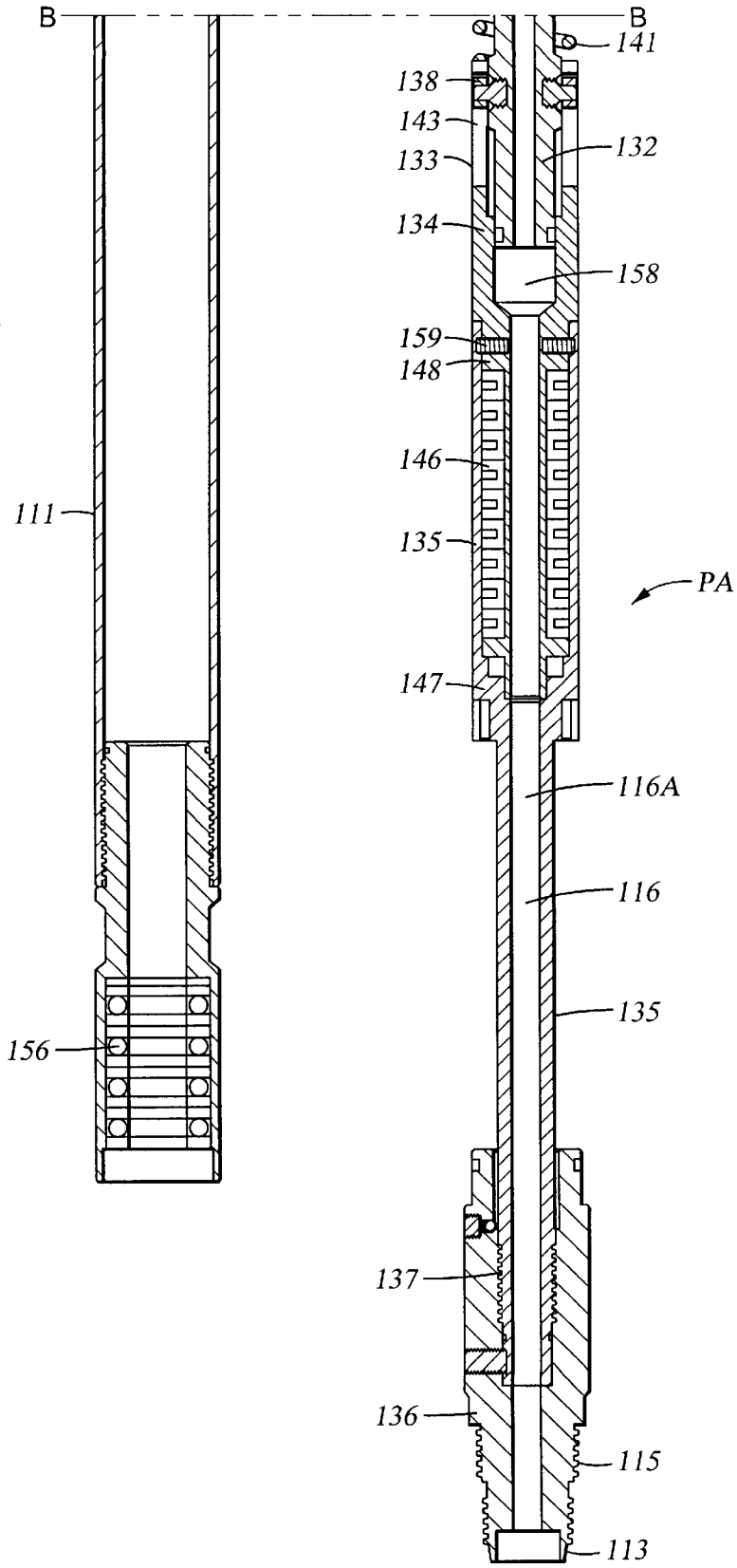
Figure 13A:
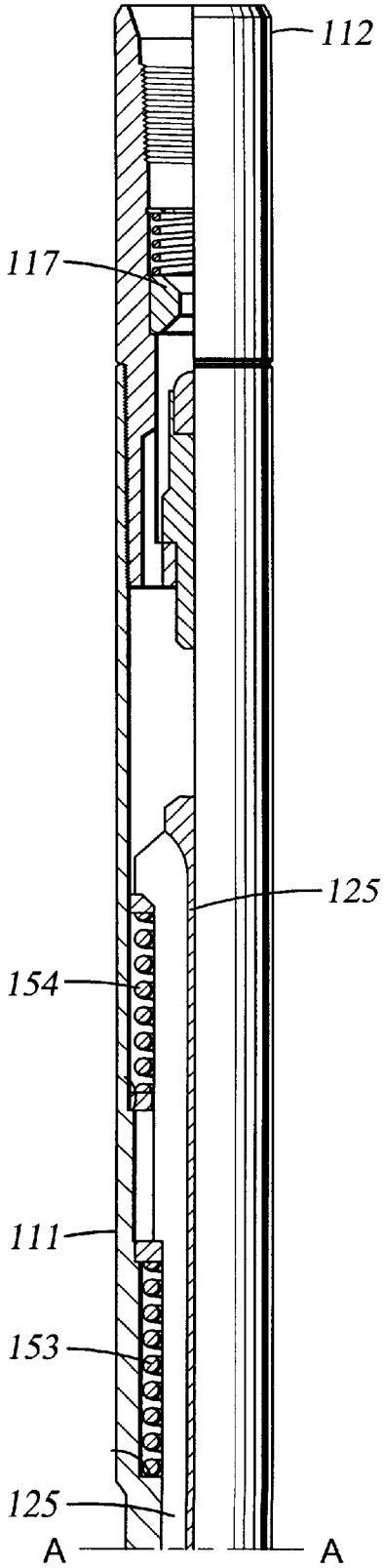
FIGS. 13A, 13B, 13C are partial sectional elevational views of the second embodiment of the apparatus of the present invention showing the tool in running position, the drawings 13A and 13B being connected at match lines "A—A" and the drawings 13B and 13C being connected at match lines "B—B" and "C—C"
Figure 13B:
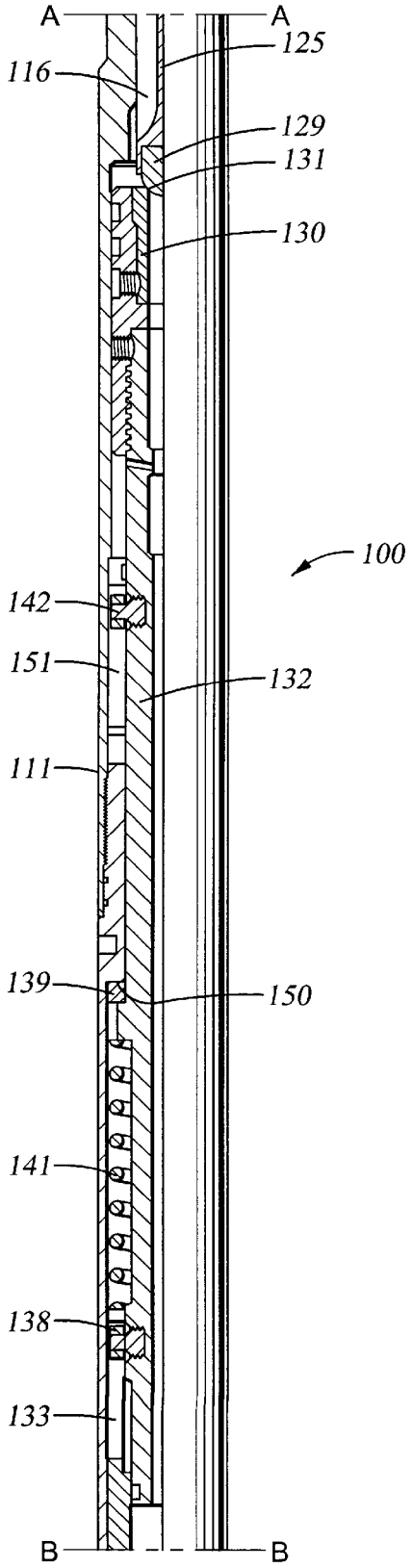
Figure 16:
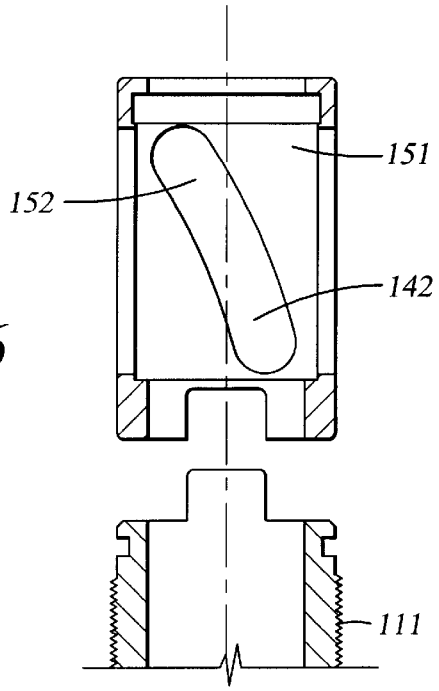
FIG. 16 is a fragmentary view of the preferred embodiment of the apparatus of the present invention that illustrates the upper helix and its diagonal slot.
Figure 17:
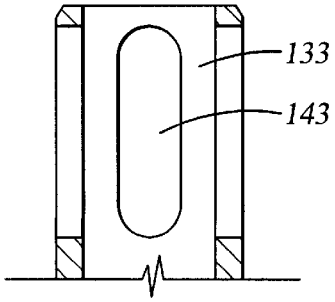
FIG. 17 is a fragmentary view of the preferred embodiment of the apparatus of the present invention that illustrates the lower helix and its vertical slot.
Figure 13C:
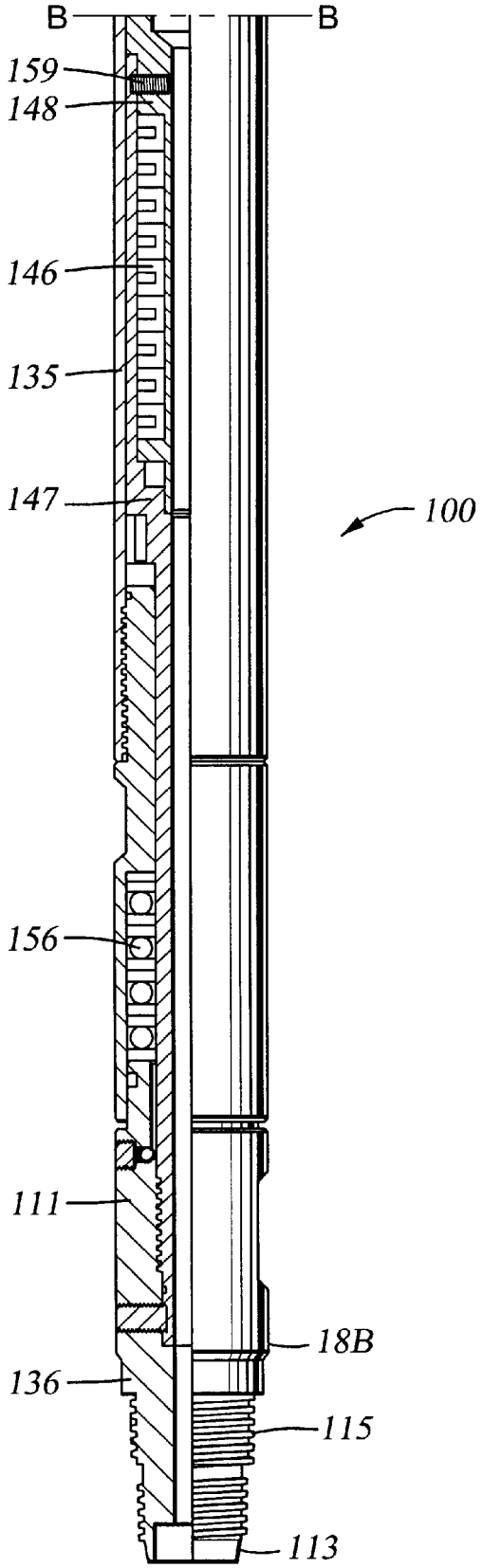

FIGS. 11A–11C, 12A–12C, 13A–13C, 14–15 show a second and preferred embodiment of the apparatus of the present invention designated generally by the numeral 100. Figures 11A–11C show the apparatus 100 in its running position with the gap 157 in FIG. 11C showing because the drill bit 17 and the piston assembly PA have fallen away to prevent valve chatter. In FIGS. 13A–13C, the apparatus 100 is shown in the operating drilling position.

As with the embodiment of FIGS. 1–10, well drilling motor apparatus 100 is in the form of an elongated tool body 111 that can be placed in the well annulus 13 of well tubing 12. Drill motor apparatus 100 of the present invention can also be used to drill through shale, rock, sand, scale, or cement. It can also be used to remove obstructions. For example, it can be used with drill bit 17 to drill through an obstruction in the same general configuration shown with the well drilling motor apparatus 10 in FIG. 1, wherein the obstruction is designated by the numeral 14. Such an obstruction 14 can be a bridge plug, metal, or rubber object. Tool body 111 includes an upper end 112, a lower end 113, and a central longitudinal bore 116. As with the embodiment of FIGS. 1–10, the drill motor 100 can be connected to a coil tubing string 15 for (see FIG. 1) lowering the apparatus 100 (in place of apparatus 10) into the well annulus 13.

The tool body provides internal threads 114 at upper end 112. External threads 115 are provided at lower end 113. The external threads 115 can receive a drill bit 17 that is threadably connected thereto. The upper end 112 of tool body 111 can be connected to a carrying tool (commercially available) that forms an interface in between a coiled tubing work string 15 or like drill string and the tool body 111.

Longitudinal bore 116 extends the length of the tool body 111 in between upper end 112 and lower end 113. Inlet port fitting 117 is fitted to tool body 111 at longitudinal bore 116 just below internal threads 114. Inlet port fitting 117 provides an inlet port 118 through which fluid can flow. This inlet port fitting 117 can be removable so that the diameter of inlet port 118 can be varied if desired depending upon the fluid to be used with the tool 10.

In FIG. 11A, a tappet 119 is slidably disposed within the bore 116 of tool body 111 just below inlet port fitting 117. Tappet 119 has a shaped valving portion 120 at its upper end that cooperates with a correspondingly shaped seat 121 on the lower or down stream side of inlet port fitting 117.

Tappet 119 provides a generally flat surface 124 at its lower end portion that registers against and corresponds in size and shape to a flat surface 27 on the upper end of dart valving member 125. The tappet 119 is slidably mounted in tool body 111 using splines 122 and correspondingly shaped grooves 123, for example. This ensures sliding movement of the tappet 119 while discouraging rotational movement thereof.

Dart valving member 125 has an upper end portion 126 with flat surface 127 and a lower valving end portion 129 that is shaped to register upon and form a seal with the seat 131 of piston 130 (see FIG. 11B). Valving member 129 at lower end portion 128 of dart valving member 125 can be hemispherically shaped for example to cooperate with and form a seal with an annular beveled seat 131 at the upper end portion of piston 130. Valving member 25 can have an "X" or cross shaped transverse cross section, a configuration for such a valving member shown in my prior U.S. Pat. No. 4,958,691, incorporated herein by reference.

In FIGS. 12B and 12C, piston 130 can be shown attached to a number of other components referred to herein as the "piston assembly" PA as including piston 130, piston roller shaft 132, upper helix rollers 142, lower helix rollers 138, clutch shaft 134, clutch housing 135, and drill bit sub 136.

These components are shown removed from the tool body 11 in FIGS. 12A, 12B, and 12C. The entire "piston assembly" PA that includes the piston 130, roller shaft 132, upper helix rollers 142, lower helix rollers 138, clutch shaft 134, clutch housing 135, and drill bit sub 136 move up and down in the bore 116 of tool body 111 during operation. In FIGS. 12B and 12C, this "piston assembly" PA is shown removed from tool body 11.

In FIG. 12B, an annular shock pad 139 is positioned above enlarged diameter annular portion 140 of piston roller shaft 132. The shock pad 139 strikes a correspondingly shaped annular shoulder 150 of tool body 111 so that damage to the tool body 111 and piston roller shaft 132 is minimized over long term use. Instead, the annular shock pad 139 is constructed of a material that is softer than the piston roller shaft 132 or the tool body 111 so that the annular shock pad 139 can be replaced after a period of time when it is worn out.

A piston return spring 141 is a coil spring that is positioned in between annular portion 140 of piston roller shaft 132 and lower helix 133 (see FIG. 12C and 13B) that is affixed to the top of clutch shaft 134. A pair of opposed roller assemblies 138 extend from piston roller shaft 132 into slot 143 of lower helix 133. Preferably a pair of rollers 138 travel in opposed slots 143 of lower helix 133 in order to enable the piston roller shaft 132 to move downwardly relative to clutch shaft 134 while eliminating any relative rotation between piston shaft 132 and clutch shaft 134.

A recess 158 in the top of clutch shaft 134 (see FIG. 12C) enables piston shaft 132 and clutch shaft 134 to telescope relative to one another. When the piston shaft 132 rotates during use, the rollers 138 engage the slots 143 and lower helix 133 to transmit rotary power from piston shaft 132 to clutch shaft 134 and then to drill bit sub 136 and drill bit 17.

A clutching arrangement does enable relative rotation of the entire piston assembly PA relative to tool body 111. Rotary power for drilling is generated when the valving member 125 and piston assembly PA reciprocate within tool body 11. That rotary power begins at upper helix 151 which is a cylindrically-shaped member rigidly attached to housing 111. The diagonal slot 152 of upper helix 152 tracks roller 142 along a diagonal path. Because tool body 111. Because tool body 111 is supported from above, it does not rotate. Likewise, the upper helix 151 does not rotate. Rather, rollers 142 (preferably two rollers and two slots 152 are 180° apart) rotate with the piston shaft 132 to which the rollers are affixed. Rotation is produced by upper helix 151 and its rollers 142 that travel in the diagonally extending slots 152 of upper helix 151.

During operation, fluid is transmitted from the well head via a work string, coiled tubing unit, or the like, to the tool body 11 and its bore 116. This operating fluid enters bore 116 through the upper end 112 of tool body 111 through inlet port 118 of inlet port fitting 117 and it flows around tappet 119 through fluid channels 153. The operating fluid then flows downwardly in bore 116 past dart valving member 125 toward piston seat 131.

As fluid flow is increased, it moves the dart valving member 125 downwardly until the valving end portion 129 of dart valving member 125 seats against piston seat 131, that position being shown in FIGS. 13A, 13B, 13C. The apparatus 10 is now in running position.

Continued fluid flow into bore 116 "pressures up" the dart valving member 125 against seat 131 and moves the internal portion of the tool down, that portion referred to herein as the "piston assembly" PA which includes piston 130, piston roller shaft 132, upper helix rollers 142, lower helix rollers 138, clutch shaft 134, clutch housing 135, and drill bit sub 136.

Figure 14:
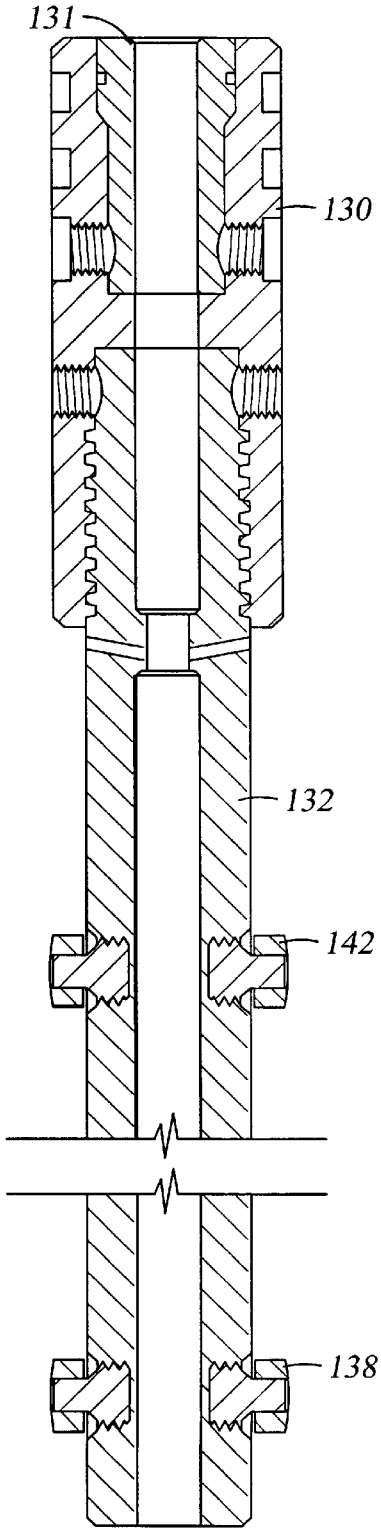
FIG. 14 is a partial view of the second embodiment of the apparatus of the present invention illustrating a transition from reciprocating motion to rotational motion.
Figure 14A:
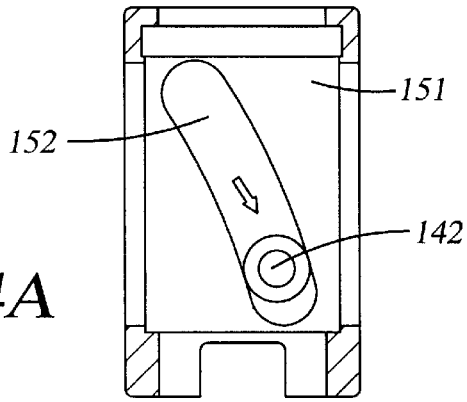
FIGS. 14A and 14B are fragmentary views of the preferred embodiment of the apparatus of the present invention showing the upper helix and lower helix respectively during the power stroke.

As this "piston assembly" (130, 132, 142, 138, 134, 135, 136) moves down, there is a rotational movement produced by the upper helix 151, its diagonally extending slot 152, and rollers 142. As the "piston assembly" moves down, it rotates. This represents a power stroke of the apparatus 10 wherein the piston assembly PA and the drill bit 17 connected thereto rotate in a clockwise direction as shown in FIGS. 14–14A. At this time, clutch sprags 146 lock clutch housing 135 and clutch shaft 134 together. The drill bit sub 136 and the drill bit connected thereto rotate about one eighth (⅛) to one quarter (¼) turn, for example, with a single stroke of the piston 130 and the "piston assembly" (130, 132, 142, 138, 134, 135, and 136). Once complete downward movement of the dart valving member 125 is achieved, the dart springs 153, 154 become fully compressed and over ride the fluid pressure that is in bore 116 above seat 131. The dart valving member 125 then fires off seat 131, moving upwardly with respect thereto. The upper end portion 126 of dart valving member 125 strikes tappet 119 as the flat surface 127 of dart valving member 125 registers against and strikes the flat surface 24 of tappet 119.

Figure 15:
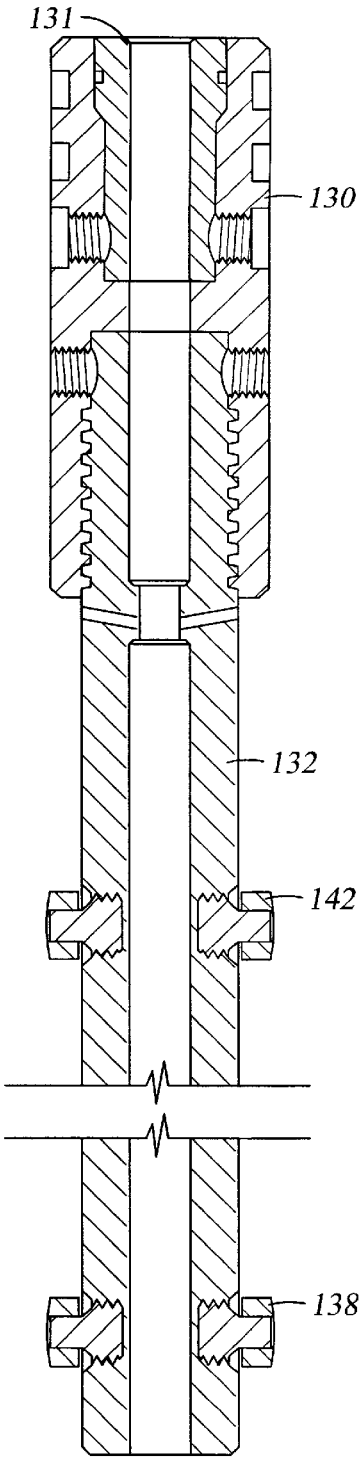
FIGS. 15, 15A and 15B are partial elevational views of the second embodiment of the apparatus of the present invention illustrating the transition from reciprocating motion to rotational motion when the clutches slip.
Figure 15A:
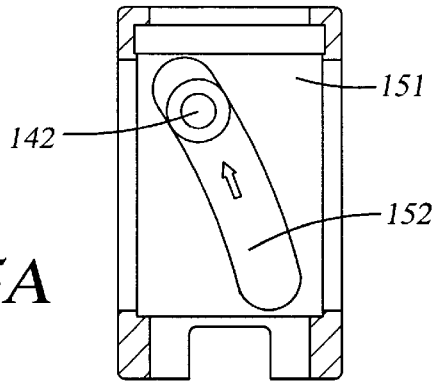
Figure 15B:
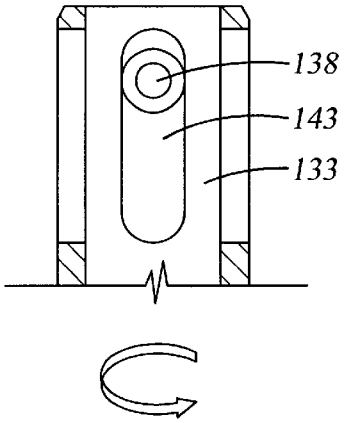

The tappet 119 moves upwardly until its valving portion 120 reaches seat 121 of inlet port fitting 117 to interrupt the flow of fluid through the inlet port fitting 117. At the same time that this happens, return spring 141 returns the piston 130 and all of the parts of the "piston assembly" PA (130, 132, 142, 138, 134, 135, and 136) back to the original position. When this occurs, the tool apparatus 10 ratchets back a quarter of a turn in a counter clockwise direction as shown in FIGS. 15, 15A, 15B. When the piston assembly PA fires back to its original starting position, the clutch sprags 146 are eccentrically shaped to slip so that clutch shaft 132 and clutch housing 135 are not locked together. When the piston 130 fires back up to its original position, the clutch sprags 146 slip so that the drill bit sub 136 and its drill bit 17 do not turn. In other words, the drill bit sub 136 and its drill bit 17 only rotate on the down stroke or power stroke of the apparatus 10.

FIGS. 11A, 11B, 11C show a "fall-away" position of the tool apparatus 100 that prevents valve "chatter" when running into the well. Since no weight is applied to the drill bit 17 when running into the well, the "piston assembly" (130, 132, 133, 134, 135, 136) falls away from the housing 111 as shown by the gap 157 in FIG 11C. This separates valving member 125 from seat 131 of piston 130 by a few inches so that circulation will not cause the valving member to reciprocate prematurely and "chatter". Circulation is important for maintaining a desired fluid pressure within the well, to keep the well from flowing, to wash sand from the well, as examples. When drilling begins, the bit 17 is weighted by the work string and tool body 11, transmitting weight through housing 111 to thrust bearing 156 and gap 157 closes as shown in FIGS. 13A, 13B, 13C.

In FIGS. 11C, 12C, 13C, the construction of the piston shaft 132, shaft 134, clutch housing 135 and its sprags 146 are shown more particularly. Piston 130 can be threadably joined to piston shaft 132 as shown in FIG. 12B. Thus, they move together as a unit. At the lower end of piston shaft 132, a sliding or telescoping connection is formed with the top of clutch shaft 134 at recess 158. Therefore, the piston 130 and piston shaft 132 reciprocate with valving member 125. The clutch shaft 134 does not reciprocate with piston 130 and piston shaft 132 but the clutch shaft 134 (and certain other parts) connected to it do rotate with piston 130 and piston shaft 132.

In FIG. 12C, lower helix 133 is mounted on the top of clutch shaft 134. Return spring 141 bottoms against lower helix 133. Clutch housing 135 is removably affixed to clutch shaft 134 with a plurality of spring loaded locking pins 159. Openings in clutch housing 135 next to locking pins 159 enable a small tool shaft to be used to press the pins against their springs when disassembly of clutch housing 135 from clutch shaft 134 is desired. Clutch housing 135 surrounds a plurality of eccentrically shaped clutch sprags 146.

The clutch housing 135 carries a plurality of clutch sprags 146 that are positioned in between annular shoulder 147 of clutch shaft 134 and annular section 148 of clutch shaft 134. Further, the clutch housing 135 surrounds the clutch sprags 146 as shown.

Figure 14B:
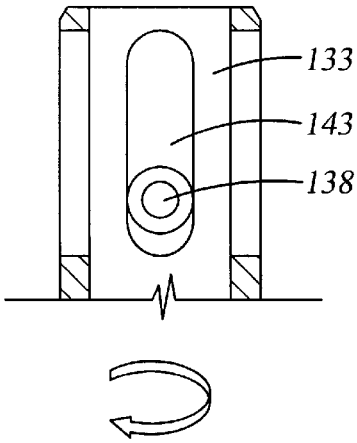

On the down stroke or power stroke as shown in FIGS. 14, 14A, 14B, the clutch sprags 146 are locked to make the drill bit 17 turn. Clutch sprags 146 can be individual elements that are eccentrically shaped to bite against clutch housing 135 during the power stroke. Such clutch sprags can be seen in FIGS. 5, 5A, 5B, and 6 of my prior U.S. Pat. No. 5,156,223, entitled "Fluid Operated Vibratory Jar With Rotating Bit", incorporated herein by reference. On the upstroke, the sprags loosen their bite against clutch housing 135 so that the apparatus ratchets back one-half turn.

The following table lists the parts numbers and parts descriptions as used herein and in the drawings attached hereto.

13/20 PARTS LIST

| Part Number | Description |
|---|---|
| 10 | well drilling motor apparatus |
| 11 | elongated tool body |
| 11A | flow bore |
| 12 | well tubing |
| 13 | well annulus |
| 14 | obstruction |
| 15 | coil tubing string |
| 16 | connector |
| 17 | drill bit |
| 18A | upper end |
| 18B | lower end |
| 19 | internal threads |
| 20 | inlet port fitting |
| 21 | opening |
| 22 | sub |
| 23 | threaded connection |
| 24 | tappet |
| 25 | upper end |
| 26 | valving member |
| 27 | seat |
| 28 | enlarged portion |
| 29 | shoulder |
| 30 | lower end |
| 31 | valving mernber |
| 32 | upper end |
| 33 | surface |
| 34 | surface |
| 35 | spring |
| 36 | spring |
| 37 | annular member |
| 38 | annular shoulder |
| 39 | annular member |
| 40 | annular shoulder |
| 41 | annular member |
| 42 | annular shoulder |
| 43 | annular shoulder |
| 44 | lower end |
| 45 | valving portion |
| 46 | piston seat |
| 47 | piston |
| 48 | annular seal |

-continued

13/20 PARTS LIST

| Part Number | Description |
|---|---|
| 49 | piston return spring |
| 50 | annular shoulder |
| 51 | piston roller shaft |
| 52 | roller |
| 53 | helix |
| 54 | diagonal slot |
| 55 | spline assernbly |
| 56 | upper reciprocating finger |
| 57 | lower reciprocating finger |
| 58 | upper seal |
| 59 | lower seal |
| 60 | arrow |
| 61 | upper interlocking spline |
| 62 | lower interlocking spline |
| 63 | locking sleeve |
| 64 | curved arrow |
| 65 | upper threads |
| 66 | lower threads |
| 70 | clutch shaft |
| 71 | threaded connection |
| 72 | clutch housing |
| 73 | clutch sprag |
| 74 | roller bearings |
| 75 | thrust bearing housing |
| 76 | thrust bearings |
| 77 | drill bit sub |
| 78 | external threads |
| 79 | sub |
| 100 | apparatus |
| 111 | tool body |
| 112 | upper end |
| 113 | lower end |
| 114 | internal threads |
| 115 | external threads |
| 116 | longitudinal bore |
| 116A | piston assembly flow bore |
| 117 | inlet port fitting |
| 118 | inlet port |
| 119 | tappet |
| 120 | valving portion |
| 121 | seat |
| 122 | splines |
| 123 | groove |
| 124 | flat surface |
| 125 | dart valving member |
| 126 | upper end |
| 127 | flat surface |
| 128 | lower end |
| 129 | valving end portion |
| 130 | piston |
| 131 | seat |
| 132 | piston roller shaft |
| 133 | lower helix |
| 134 | clutch shaft |
| 135 | clutch housing |
| 136 | drill bit sub |
| 137 | threaded connection |
| 138 | lower roller |
| 139 | annular shock pad |
| 140 | annular portion |
| 141 | piston return spring |
| 142 | upper roller |
| 143 | helix slot |
| 144 | enlarged bore section |
| 145 | lower end portion |
| 146 | clutch sprag |
| 147 | annular section |
| 148 | annular section |
| 149 | threaded connection |
| 150 | annular shoulder |
| 151 | upper helix |
| 152 | diagonally extending slot |
| 153 | dart spring |
| 154 | dart spring |
| 155 | return spring |
| 156 | thrust bearing assembly |

-continued

| 13/20 PARTS LIST | |
|---|---|
| Part Number | Description |
| 157 | gap |
| 158 | recess |
| 159 | locking pin |

The foregoing embodiments are presented by way of example only; the scope of the present invention is to be limited only by the following claims.

I claim:

1. A fluid operated drill motor that operates with gaseous or liquid well drilling fluid or drilling mud, comprising:

a) an elongated tool body having a flow bore, an upper end portion with a connector that enables the tool body to be attached to work string, and a lower connector that enables a drill bit to be connected to the lower end of the tool body;

b) a reciprocating valving member that travels between a first upper and a second lower position within the tool body bore;

c) a piston carried in the tool body bore below the valving member, the piston having an upper end portion with a valve seat, and the valving member having a lower end portion that can form a seal with the seat;

d) the piston being powered to move downwardly within the flow bore with the valving member from differential fluid pressure applied to the combination of valving member and piston when the valving member lower end portion forms said seal at said seat;

e) compressible valving member spring positioned in the tool body to engage the valving member, the springs gradually compressing as the valving member moves downwardly within the flow bore;

f) a full compression of the valving member springs enabling the springs to override the fluid pressure acting on the combination of piston and valving member so that the valving member can separate from the piston and its seat;

g) a drill bit attached to the lower connector; and h) a transmission that rotates the drill bit without transmitting impact thereto from the reciprocating piston and valving member.

2. The fluid operated drill motor of claim 1 wherein the piston moves to a fall-away position when the tool body is run into the well that prevents chatter between the valving member and valve seat.

3. The fluid operated drill motor of claim 1 wherein the transmission includes a splined linkage that has first and second interlocking, telescoping members.

4. The fluid operated drill motor of claim 3 further comprising a helix with a diagonally extending slot and a roller that travels in the slot, the roller moving with the piston and the helix being connected via a clutch to the drill bit.

5. The fluid operated drill motor of claim 1 wherein the transmission includes a piston roller shaft depending from a lower end portion of the piston, a roller carried by the piston roller shaft and a helix with a diagonally slotted portion that receives the roller.

6. The fluid operated drill motor of claim 1 further comprising a piston spring that returns the piston to its upper position when the valve spring separates the valving member and piston.

7. The fluid operated drill motor of claim 1 further comprising fluid interruption means for momentarily interrupting fluid flow in the bore during a cycle of the valving member between its upper and lower positions.

8. The fluid operated drill motor of claim 7 wherein the fluid interruption means includes a flow interruption member positioned above the valving member.

9. The fluid operated drill motor of claim 1 wherein the valving member has an upper end portion with a hammering surface thereon and further comprising a tappet positioned in the flow bore above the valving member in a position that enables the valving member to strike the tappet when the valving member travels from a lower to an upper position and wherein the tappet momentarily interrupts flow in the bore at the upper end portion of the tool body when it is struck by the valving member.

10. The fluid operated drill motor of claim 6 wherein the valving member and piston move downwardly in the tool body, gradually compressing both the valving member spring and the piston spring.

11. The fluid operated drill motor of claim 10 wherein there are a plurality of valving member springs positioned in the flow bore, each engaging the housing and the valving member.

12. The fluid operated drill motor of claim 1 wherein the transmission includes a telescoping member that retracts when the valving member and piston move from the first, upper position to the second, lower position.

13. The fluid operated drill motor of claim 1 wherein the telescoping member carries a torque load.

14. The fluid operated drill motor of claim 1 wherein the transmission includes means for translating reciprocating movements of the piston into rotational energy while isolating the drill bit from any substantial reciprocating movement of the piston.

15. The fluid operated drill motor of claim 14, wherein the transmission turns the drill bit with low speed, low r.p.m. of between about 30 and 500 r.p.m.

16. The fluid operated drill motor of claim 14 wherein the transmission turns the drill bit with high torque of between about 20 and 1200 foot pounds.

17. The fluid operated drill motor of claim 14 wherein the transmission turns the drill bit with low r.p.m. of less than 500 r.p.m.

18. The fluid operated drill motor of claim 1 wherein the transmission rotates while absorbing the reciprocating action of the valve member and piston.

19. A fluid operated drill motor that operates with well drilling fluid or drilling mud, comprising:

a) an elongated tool body having a flow bore, an upper end portion with a connector that enables the tool body to be attached to work string, and a lower connector that enables a drill bit to be connected to the lower end of the tool body;

b) a reciprocating valve member that travels between a first upper and a second lower position within the tool body bore;

c) a reciprocating piston carried in the tool body bore below the valving member, the piston having an upper end portion with a valve seat, and the valving member having a lower end portion that can form a seal with the seat;

d) the piston being powered to move downwardly within the flow bore with the valving member from differential fluid pressure applied to the combination of the valving member and the piston that is generated with drilling fluid drilling mud above the valve seat when the valving member lower end portion forms said seal at said seat;

e) a valve return member positioned in the tool body to engage the valving member, the return member separating the valving member and piston as the valving member moves downwardly within the flow bore to the second, lower position;

f) the valve return member overriding the fluid pressure acting on the combination of piston and valving member so that the valving member can separate from the piston and its seat;

g) a drill bit attached to the lower connector; and h) means for rotating the drill bit without transmitting substantial impact thereto from the reciprocating piston.

20. The fluid operated drill motor of claim 19 further comprising a transmission that includes a splined linkage that has first and second interlocking, telescoping members for interfacing the piston and drill bit.

21. The fluid operated drill motor of claim 20 further comprising a helix with a diagonally extending slot and a roller that travels in the slot, the roller moving with the piston and the helix being connected via a clutch to the drill bit.

22. The fluid operated drill motor of claim 19 wherein the transmission includes a piston roller shaft depending from a lower end portion of the piston, a roller carried by the piston roller shaft and a helix with a diagonally slotted portion that receives the roller.

23. The fluid operated drill motor of claim 19 further comprising a piston return member that returns the piston to its upper position when the valve spring separates the valving member and piston.

24. The fluid operated drill motor of claim 19 further comprising fluid interruption means for momentarily interrupting fluid flow in the bore during a cycle of the valving member between its upper and lower positions.

25. The fluid operated drill motor of claim 24 wherein the fluid interruption means includes a flow interruption member positioned above the valving member.

26. The fluid operated drill motor of claim 19 wherein the valving member has an upper end portion with a hammering surface thereon and further comprising a tappet positioned in the flow bore above the valving member in a position that enables the valving member to strike the tappet when the valving member travels from a lower to an upper position and wherein the tappet momentarily interrupts flow in the bore at the upper end portion of the tool body when it is struck by the valving member.

27. The fluid operated drill motor of claim 23 wherein the valving member and piston move downwardly in the tool body, gradually compressing both the valving member spring and the piston spring.

28. The fluid operated drill motor of claim 27 wherein there are a plurality of valving member springs positioned in the flow bore, each engaging the housing and the valving member.

29. The fluid operated drill motor of claim 20 wherein the transmission includes a telescoping member that retracts when the valving member and piston move from the first, upper position to the second, lower position.

30. The fluid operated drill motor of claim 20 wherein the telescoping member carries a torque load.

31. The fluid operated drill motor of claim 20 wherein the transmission includes means for translating reciprocating movements of the piston into rotational energy while isolating the drill bit from any substantial reciprocating movement of the piston.

32. The fluid operated drill motor of claim 31, wherein the transmission turns the drill bit with low speed, low r.p.m. of between about 30 and 500 r.p.m.

33. The fluid operated drill motor of claim 31 wherein the transmission turns the drill bit with high torque of between about 25 and 1200 foot pounds.

34. The fluid operated drill motor of claim 31 wherein the transmission turns the drill bit with low r.p.m. of less than 500 r.p.m.

35. The fluid operated drill motor of claim 20 wherein the transmission rotates while absorbing the reciprocating action of the valve member and piston.

36. A fluid operated drill motor that operates with well drilling fluid or drilling mud, comprising:

a) an elongated tool body having a flow bore, an upper end portion with a connector that enables the tool body to be attached to work string, and a lower connector that enables a drill bit to be connected to the lower end of the tool body;

b) a reciprocating valve member that travels between a first upper and a second lower position within the tool body bore;

c) a reciprocating piston carried in the tool body bore below the valving member, the piston having an upper end portion with a valve seat, and the valving member having a lower end portion that can form a seal with the seat;

d) the piston being powered to move downwardly within the flow bore with the valving member from differential fluid pressure applied to the combination of the valving member and the piston that is generated with drilling fluid drilling mud above the valve seat when the valving member lower end portion forms said seal at said seat;

e) a valve return member positioned in the tool body to engage the valving member, the return member separating the valving member and piston as the valving member moves downwardly within the flow bore to the second, lower position;

f) the valve return member overriding the fluid pressure acting on the combination of piston and valving member so that the valving member can separate from the piston and its seat;

g) a drill bit attached to the lower connector;

h) a transmission for rotating the drill bit without transmitting substantial impact thereto from the reciprocating piston; and i) means for reducing valve chatter between the valving member and the valve seat when the tool body is being run into the well and prior to operation such as drilling operation.

37. The fluid operated drill motor of claim 36 wherein the transmission turns the drill bit with high torque of between about 20 and 250 foot pounds.

38. The fluid operated drill motor of claim 36 wherein the transmission turns the drill bit with a low r.p.m. of between about 30 and 160 r.p.m.

* * * * *